US007467985B2

(12) United States Patent
Manrique

(10) Patent No.: US 7,467,985 B2
(45) Date of Patent: Dec. 23, 2008

(54) THREE DIMENSIONAL STORYBOOK

(76) Inventor: Anne L. Manrique, 137 N. Larchmont Blvd., #197, Los Angeles, CA (US) 90004

( * ) Notice: Subject to any disclaimer, the term of this patent is extended or adjusted under 35 U.S.C. 154(b) by 0 days.

(21) Appl. No.: 10/985,683

(22) Filed: Nov. 12, 2004

(65) Prior Publication Data

US 2006/0105665 A1 May 18, 2006

(51) Int. Cl.
*A63H 33/38* (2006.01)
*A63H 33/00* (2006.01)

(52) U.S. Cl. ..... 446/147; 446/149; 446/108; 434/403

(58) Field of Classification Search ..... 472/62, 472/136; 446/107–111, 147–150, 487, 476, 446/478, 403; 434/403, 408
See application file for complete search history.

(56) References Cited

U.S. PATENT DOCUMENTS

| | | | | | |
|---|---|---|---|---|---|
| 984,735 | A * | 2/1911 | Bailey | 446/82 |
| 3,452,989 | A * | 7/1969 | Jernstrom | 273/276 |
| 3,471,962 | A * | 10/1969 | Klein | 446/97 |
| 4,212,130 | A * | 7/1980 | Walker | 446/111 |
| 4,764,142 | A * | 8/1988 | Griffith et al. | 446/82 |
| 4,793,286 | A * | 12/1988 | Buxton | 119/498 |
| 4,946,414 | A * | 8/1990 | Zimmer | 446/71 |
| 5,014,455 | A * | 5/1991 | Desaderata | 40/539 |
| 5,069,623 | A * | 12/1991 | Peat | 434/260 |
| 5,085,609 | A * | 2/1992 | Haberle | 446/83 |
| 5,096,204 | A * | 3/1992 | Lippman | 273/285 |
| 5,219,316 | A * | 6/1993 | Huffman | 472/62 |
| 5,352,149 | A * | 10/1994 | Melashenko et al. | 446/478 |
| 5,487,690 | A * | 1/1996 | Stoffle et al. | 446/105 |
| 5,491,950 | A * | 2/1996 | Obegi | 52/693 |
| 5,525,088 | A * | 6/1996 | Mayne | 446/75 |
| 5,540,609 | A * | 7/1996 | Hoag | 446/26 |
| 5,542,870 | A * | 8/1996 | Westersund | 446/75 |
| 5,577,465 | A * | 11/1996 | Cook | 119/498 |
| 5,706,613 | A * | 1/1998 | Drake et al. | 52/79.1 |
| 5,775,969 | A * | 7/1998 | Pedersen | 446/110 |
| 5,961,149 | A * | 10/1999 | Hunt | 281/22 |
| 6,068,556 | A * | 5/2000 | Bernstein | 472/77 |
| 6,071,174 | A * | 6/2000 | Yoon | 446/478 |
| 6,210,172 | B1 * | 4/2001 | Clements | 434/428 |
| 6,419,493 | B1 * | 7/2002 | Cole | 434/81 |
| 6,506,093 | B2 * | 1/2003 | Avital | 446/83 |
| 6,560,095 | B1 * | 5/2003 | Zheng | 361/683 |
| 6,694,994 | B1 * | 2/2004 | Zheng | 135/126 |
| 6,905,338 | B1 * | 6/2005 | Garran | 434/79 |
| 7,014,524 | B2 * | 3/2006 | Farmer Brock et al. | 446/82 |
| 2006/0040582 | A1 * | 2/2006 | Hopper et al. | 446/75 |

* cited by examiner

*Primary Examiner*—Kien T Nguyen
(74) *Attorney, Agent, or Firm*—Kelly Lowry & Kelley, LLP

(57) ABSTRACT

A three dimensional storybook with a plurality of base plates, a plurality of horizontal and vertical support poles, a plurality of pole connecting members and a fabric floor portion The floor portion terminates at each edge in a base plate retaining loop of fabric. A plurality of felt wall curtains are each capable of being hung on a the horizontal support poles. The felt curtains include decorative graphics that correspond with a story as told in a two dimensional storybook. A plurality of graphic felt accessory panels that relate to the story can be attached to the curtains and or floor portion. A see through fabric mesh panel acts as a roof portion. Multiple structures can be placed side by side so that a child can crawl from one portion of the story to the next.

5 Claims, 11 Drawing Sheets

THREE DIMENSIONAL STORYBOOK

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of children's play structures and more specifically to three dimensional storybook play structure.

It has been a tradition for hundreds of years to tell stories to young children as part of a child's learning process. Originally stories were told orally and passed from one generation to the next. More recently, printed story books have become very popular as a means of telling stories to children. Traditional children's books consist of painted or drawn pictures printed on two dimensional pages and combined with text. Pop-up flaps have been included in some new books to add some three dimensionality to the story telling experience.

However, the concept of providing a large scale three dimensional representation for a story has not been developed to date. Others have proposed structures that help a child participate in creative play such as John Ryan's patent U.S. Pat. No. 3,363,360 which discloses a doll house structure that includes additions to the walls that can represent parts of a house such as a kitchen stove. Miriam Kelley, in her patent U.S. Pat. No. 5,733,165 discloses a play structure that includes additional play figures that relate to play surfaces on the interior of the structure. Paula Coleman, in her patent U.S. Pat. No. 5,004,445 discloses a series of shapes of home furniture and kitchen appliances, that when opened, reveal a miniature environment relating to that particular item. For example, the side of a play bed structure can fold out to reveal an entire miniature bedroom. Connie Melashenko, in her patent U.S. Pat. No. 5,352,149 discloses a children's play structure with interchangeable scenes. This patent shows a play structure where graphic elements can be added to the interior walls adapting the space to a classroom, or a kitchen, or the like.

However, none of the above described patents, or other patents in this category, describe a novel approach to story telling a portion of a play structure represents a page or pages of a story book, and by crawling or walking from one play structure to the next, a child can travel through a story in a three dimensional manner.

BRIEF SUMMARY OF THE INVENTION

The primary object of the invention is to provide a structure that allows a child experience a storybook in a three dimensional format.

Another object of the invention is to provide one version of the three dimensional storybook structure that is the size of a child's playhouse.

Another object of the invention is to provide an alternate version of a three dimensional structure that is a story in a box.

A further object of the invention is to provide a three dimensional storybook structure that can be easily assembled and disassembled.

Yet another object of the invention is to provide a three dimensional storybook structure that allows the user to easily attach and detach graphic accessories.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a three dimensional storybook comprising: a plurality of base plates, a plurality of horizontal and vertical support poles, a plurality of pole connecting members, and a fabric floor portion. The floor portion terminates at each edge in a base plate retaining loop of fabric. A plurality of felt wall curtains are each capable of being hung on said horizontal support poles. The curtains include decorative graphics that correspond with a story as told in a two dimensional storybook. A plurality of graphic felt accessory members relate to said story and can be attached to said curtains and or floor portion. A see through fabric mesh roof portion allows a child to feel enclosed yet still in contact with the outside world.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
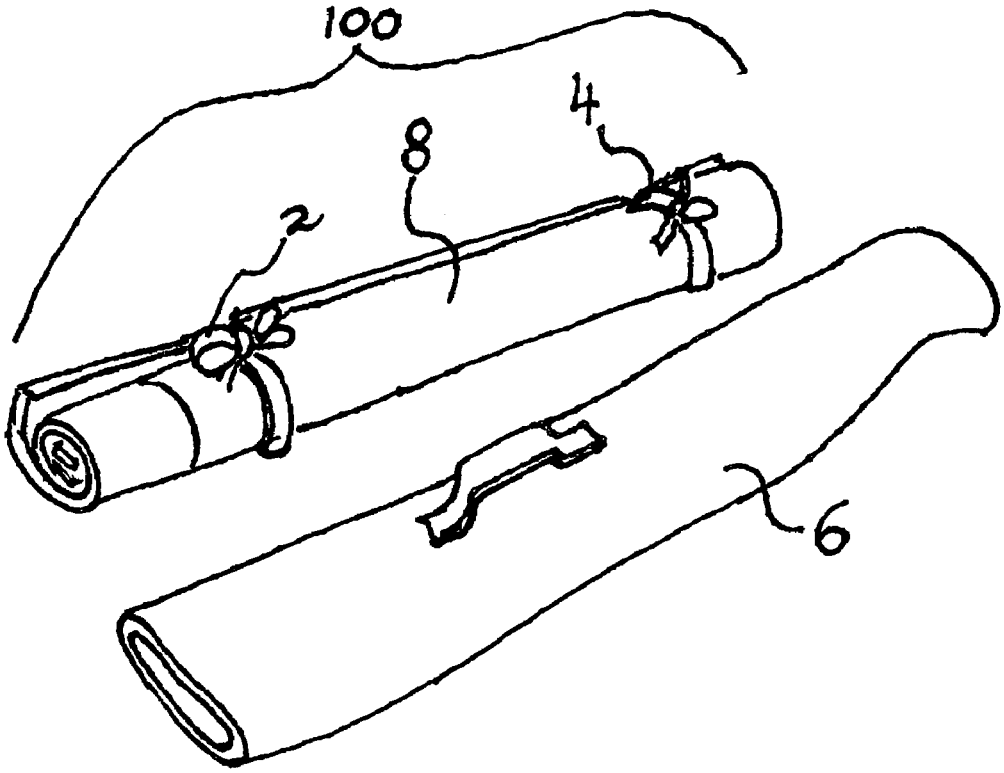
FIG. 1 is a perspective view of the invention in its stored position.
Figure 2:
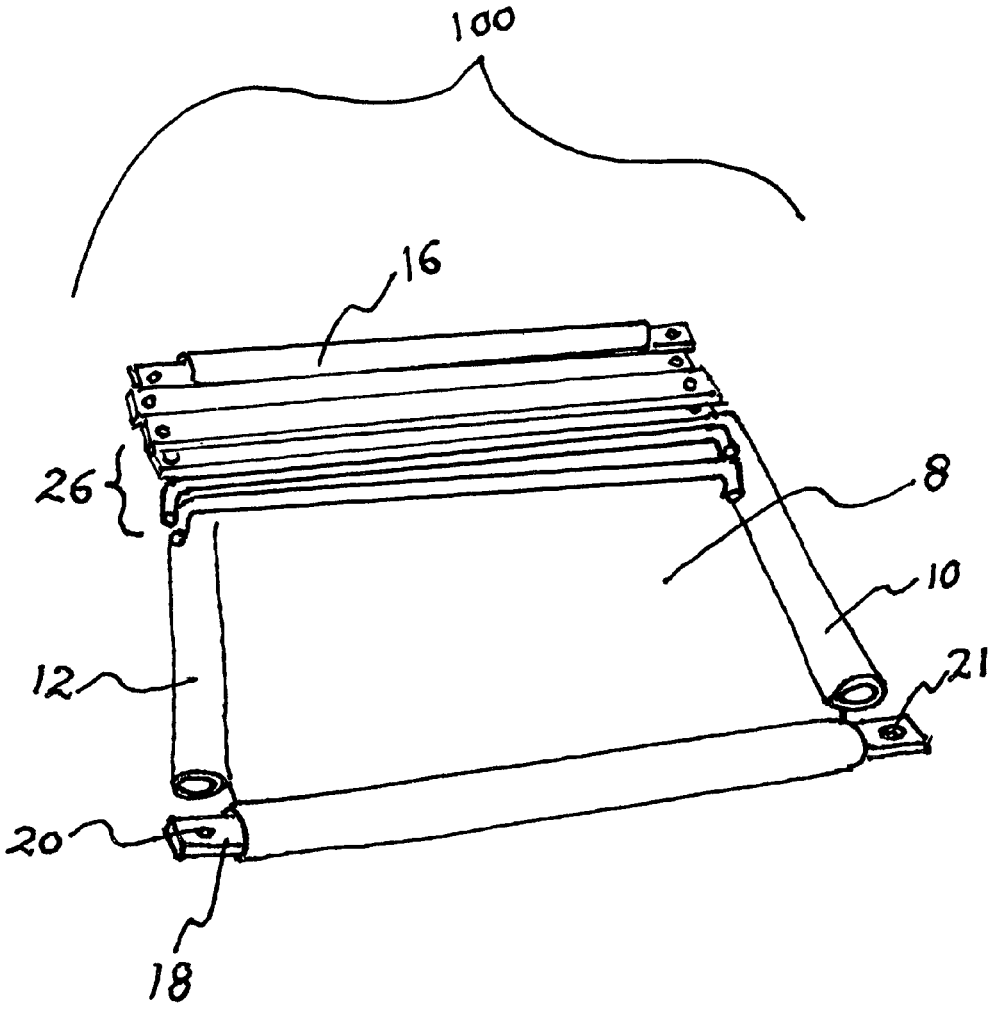
FIG. 2 is a perspective view of the parts of the invention laid flat on the ground.
Figure 3:
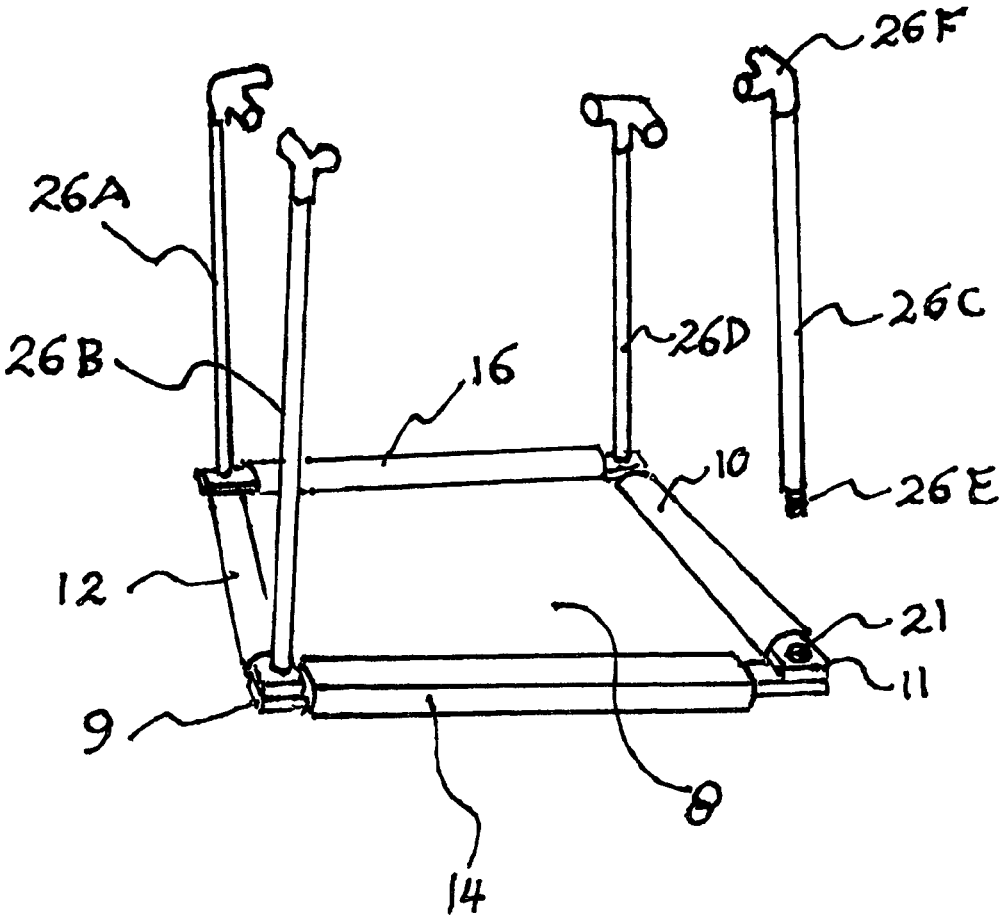
FIG. 3 is a perspective view of the skeleton structure of the invention.
Figure 4:
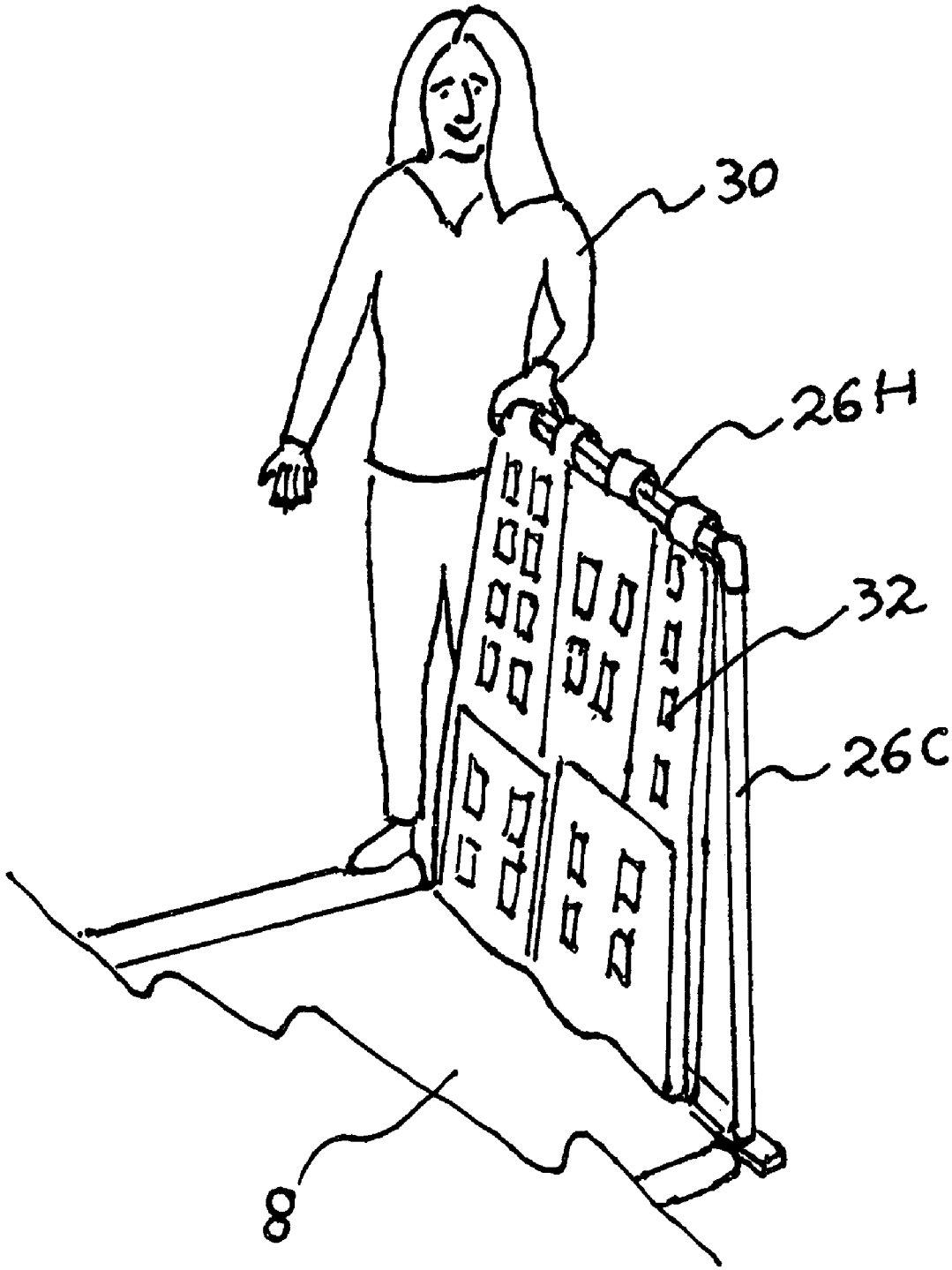
FIG. 4 is a perspective view of one fabric wall panel in place.
Figure 5:
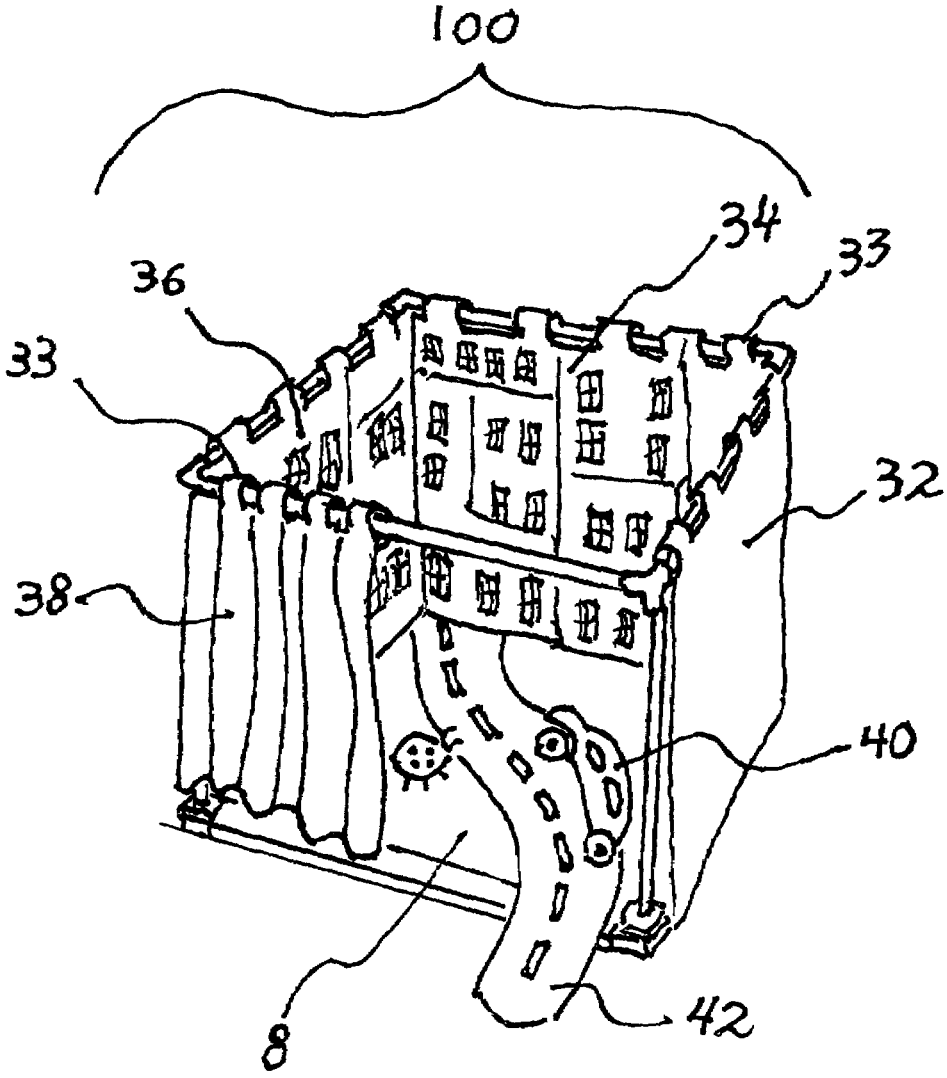
FIG. 5 is a perspective view of an entire play structure assembled.
Figure 6:
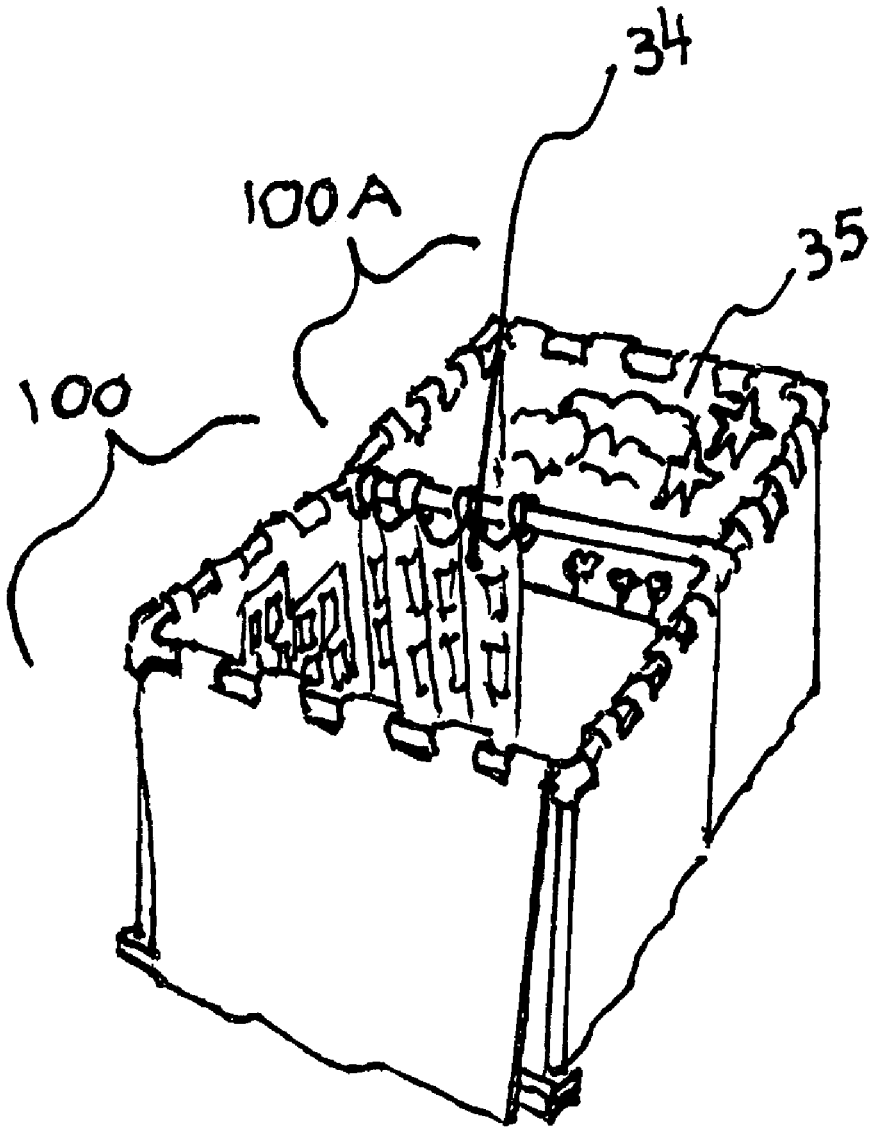
FIG. 6 is a perspective view of two play structures side by side.
Figure 7:
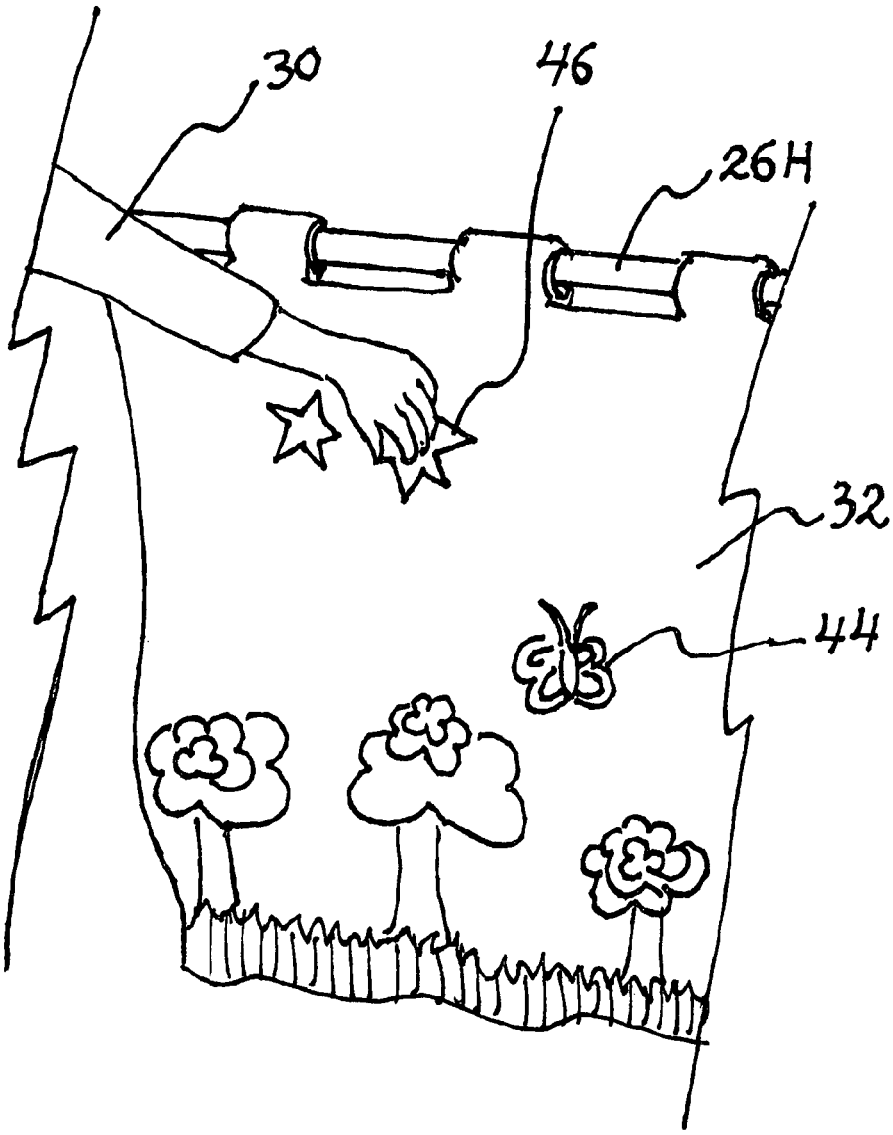
FIG. 7 is a partial perspective view of a person adding a felt graphic element to a felt curtain wall.

Referring now to FIG. 1 we see a perspective view of the invention 100 in its stored form the structural components are stored within the rolled up floor 8 of the invention and held in rolled form by ties 2, 4. The entire structure 100 can be inserted into stuff bag 6 and easily carried via handle 7. FIG. 2 shows floor 8 unrolled and reveals support poles 26 and base plates 18, 22 that are slid into tubular pockets 14, 16 at the edge of floor 8. Pockets 10 and 12 accept base plates 9 and 11 as shown in FIG. 3. FIG. 3 also shows how poles 26 A,B,C,D screw into base plates via screw portion 26E and its mating aperture 21. The support poles can be made of PVC pipe or be wooden dowles. Connectors 26F support horizontal rods 26H as shown in FIG. 4. The horizontal rods 26H support felt curtain walls 32. The scale of the overall structure is evidenced by the woman 30 who is constructing the structure. FIG. 5 shows a completed structure that illustrates a city scene that appears in a companion two dimensional story book. Notice that a cityscape appears on the walls 34, 36 and floor 8. This gives a child who inhabits the structure 100 the sensation of being in the story. To further enhance the experience, the child can add separate graphic elements such as the car 40 that is traveling on a city street 42. Wall 38 is shown slid to one side via loops 33. In this way, the child can easily enter and exit the structure 100 and can walk or crawl to adjacent structures as shown in FIG. 6. Structure 100A illustrates the next phase or page of the story. In this way the child can crawl or walk through the story in a three dimensional manner thereby enhancing his or her experience of the story and even personalizing the story to his or her liking. Wall 34 is shown slid to one side to allow for entrance to the next structure 100A. See through mesh 35 gives the child a sense of full enclosure and yet can, reassuringly, still see to the outside world. FIG. 7 shows a person 30 attaching a separate felt graphic element 46 to felt wall 32. Felt has a natural adhesion to itself so the graphic elements 46, 44 attach to the wall 32 without need of special adhesives.

Figure 8:
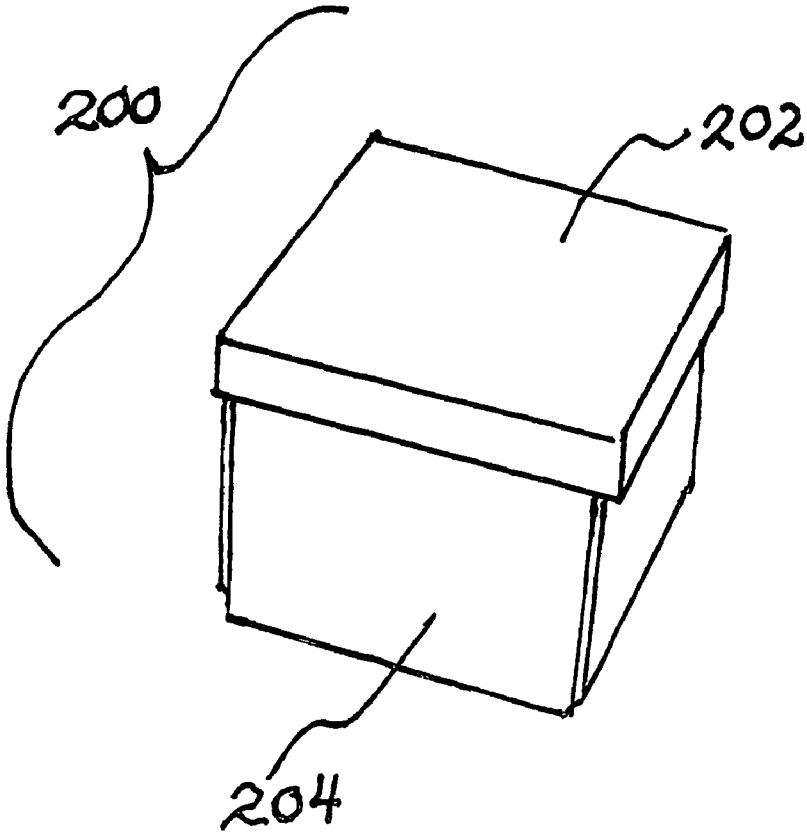
FIG. 8 is a perspective closed view of an alternate embodiment of the invention where a story is in a box.
Figure 9:
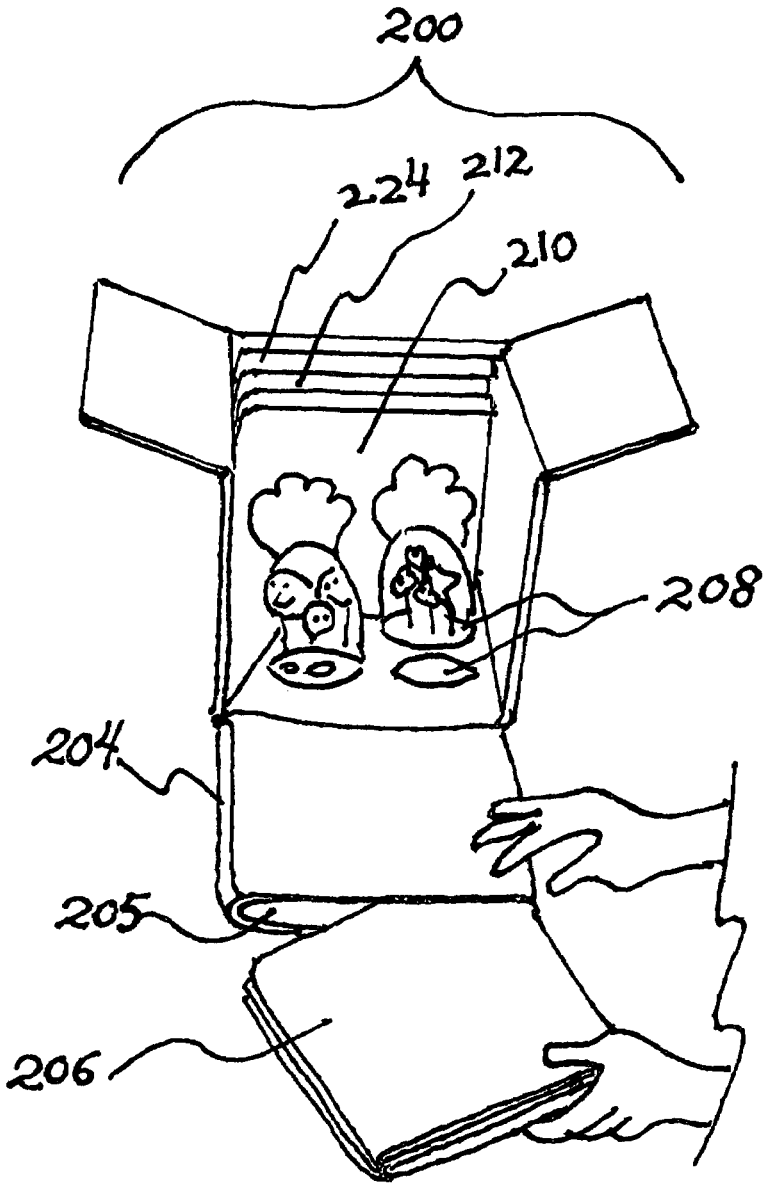
FIG. 9 is a perspective open view of the contents of a story in a box.
Figure 10:
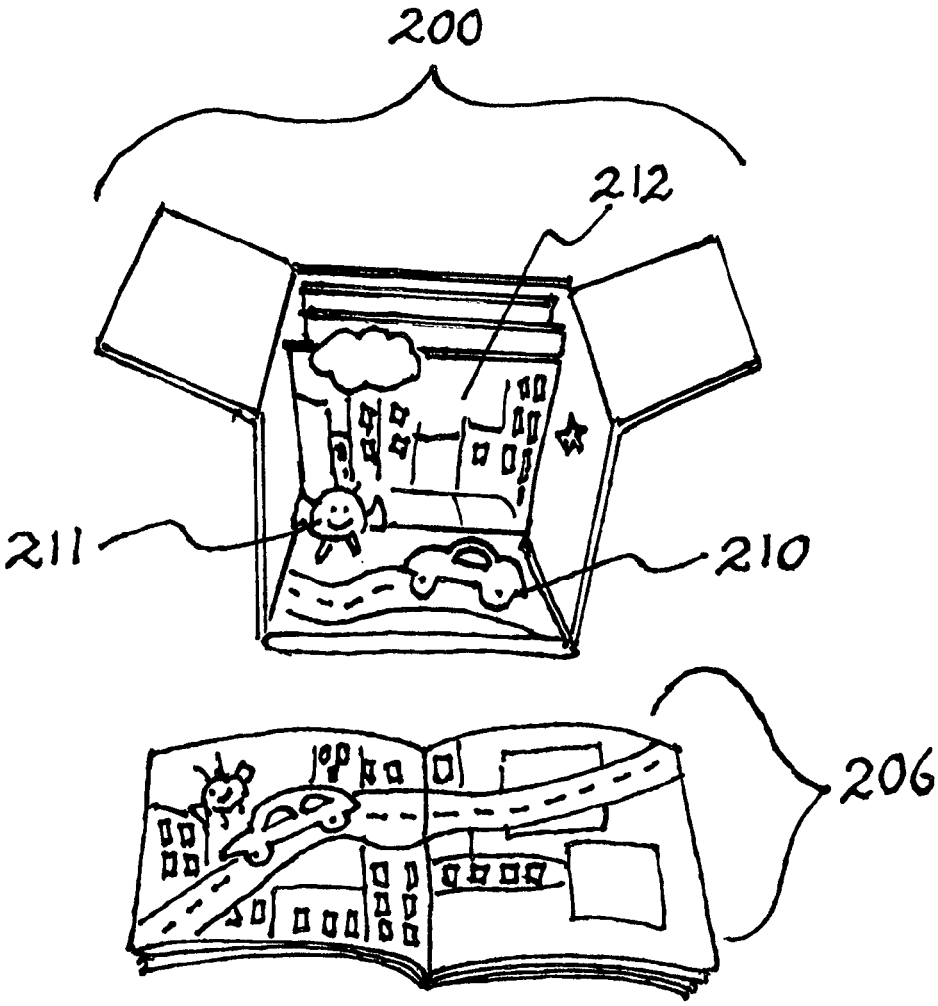
FIG. 10 is a perspective view of a story in progress.
Figure 11:
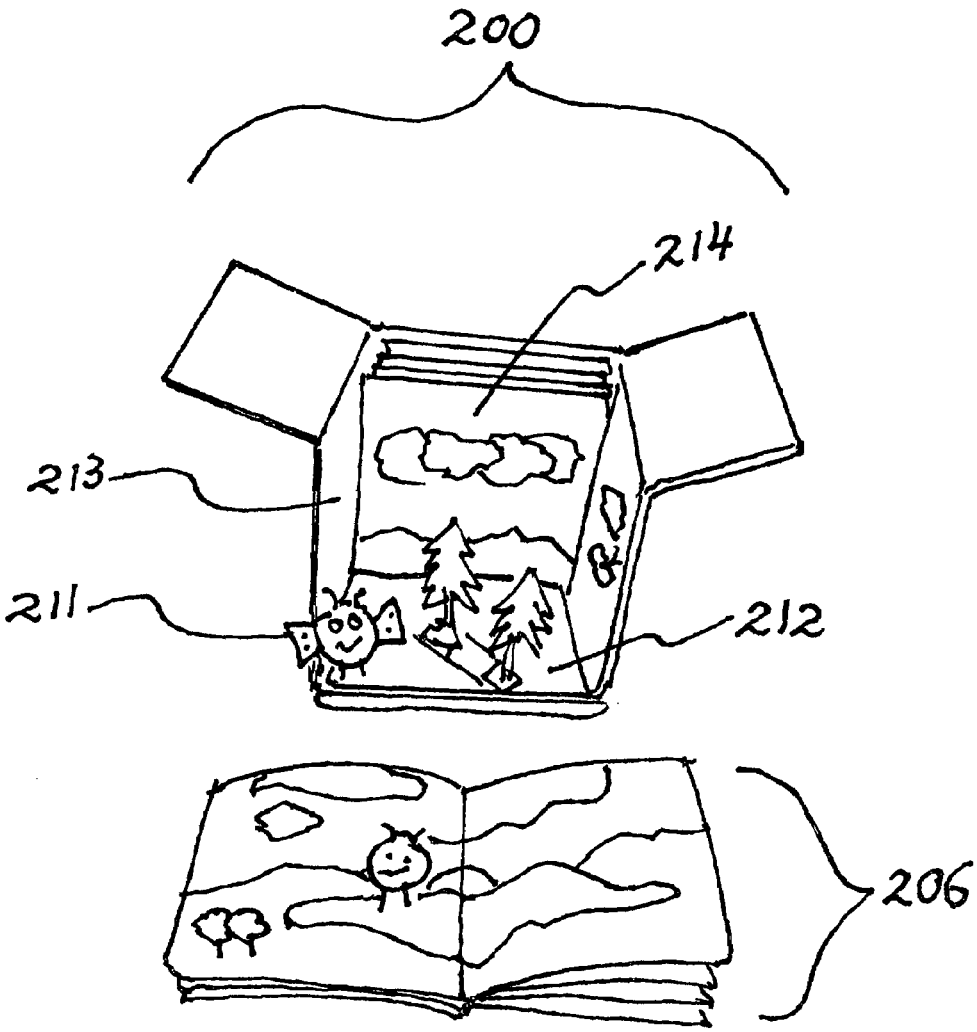
FIG. 11 is an additional view of a story in progress.

FIG. 8 shows an alternate embodiment 200 of the present invention. Instead of being a large crawl through structure, it is a box approximately twelve inches square that has a top 202 and sides 204. FIG. 9 shows the box in an open position where the front panel is folded down and a person is pulling out a storybook 206 from a sleeve 205 located on panel 204. The box has a plurality of rear panels 210, 212, 214. The box also houses separate three dimensional elements 208 that relate to the story being told in book 206. The user folds down the rear panels sequentially and the back of one panel becomes the floor in the next sequence. For example the back of panel 210 has become the floor of a city scene and the front of the rear wall is the backdrop of the scene. The scene corresponds to the scene in two dimensional storybook 206. To add to the play value, separate three dimensional elements such as auto 210 and bug character 211, as also shown by packages 208 in FIG. 9, can be added into the box. The interior walls of the box are made of felt, so additional graphic elements can be attached to the walls as previously described in the larger play structure 100. FIG. 11 shows another part of the story where panel 212 has been folded down to become the floor of the scene and panel 214 is now the back wall. In this scene the bug character 211 is in a country setting similar to that shown in storybook 206. Three dimensional trees 213 add to the realism of the scene.

The above description and figures illustrate that the present invention provides a novel, three dimensional way for a child to experience a story.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A storybook kit, comprising:

a storybook having a plurality of two dimensional pages; and a three dimensional structure including a vertically oriented rear panel and vertically oriented side panels extending outwardly from opposite side edges of the rear panel such that the side panels are generally facing one another, and the rear and side panels are arranged to form a three dimensional box-like structure, at least one inwardly facing surface of each of the panels having graphic representations thereon and cooperatively corresponding to at least a portion of a scene depicted in a single page or facing pages of the two dimensional storybook;

wherein the three dimensional structure includes a plurality of rear panels, each rear panel having a different graphic representation on a front surface thereof corresponding to a scene depicted in the storybook; and wherein the rear panels are pivotable downwardly, and wherein a rear surface of the rear panels have a graphic representation of a floor or ground surface corresponding to a scene depicted in the storybook.

2. The storybook kit of claim 1, including an object positionable in the three dimensional structure, wherein the object corresponds to an object depicted in the storybook.

3. The storybook kit of claim 2, wherein the object is removably attached to a surface of the panels.

4. A storybook kit, comprising:

a storybook having a plurality of two dimensional pages; and a structure including a vertically oriented rear panel and opposing vertically oriented side panels arranged to form a three dimensional box-like structure, an inner surface of each of the panels includes graphic representations which cooperatively form an illustration corresponding to an illustration on a page or facing pages of the storybook;

wherein the three dimensional structure includes a plurality of rear panels, each rear panel having a different graphic representation on a front surface thereof corresponding to a page depicted in the storybook; and wherein the rear panels are pivotable downwardly, and wherein a rear surface of the rear panels have a graphic representation of a floor or ground surface corresponding to a different page depicted in the storybook.

5. The storybook kit of claim 4, including a three dimensional object positionable in the three dimensional structure, wherein the three dimensional object corresponds to an object depicted in the storybook.

* * * * *